US005463825A

United States Patent [19]

Lo

[11] Patent Number: 5,463,825

[45] Date of Patent: Nov. 7, 1995

[54] DUMMY PASSENGER

[76] Inventor: Hsin-Hsin Lo, 9,Alley 3,Lane 35,Weiato Rd., N. Dis Taichung, Taiwan

[21] Appl. No.: 239,021

[22] Filed: May 3, 1994

[51] Int. Cl.[6] ..... G09F 19/08

[52] U.S. Cl. ..... 40/414; 40/411

[58] Field of Search ..... 446/300, 337, 446/338; 434/262, 267, 270; 40/411, 414, 592, 593; 223/66; 74/42, 43, 98

[56] References Cited

U.S. PATENT DOCUMENTS

| | | | |
|---|---|---|---|
| 1,577,903 | 3/1926 | Gover et al. | 40/414 |
| 2,893,251 | 7/1959 | McWethy | 74/42 |
| 3,707,782 | 1/1973 | Alderson | 434/267 |
| 3,900,991 | 8/1975 | Kosicki et al. | 446/338 |
| 3,956,942 | 5/1976 | Seki et al. | 74/42 X |
| 4,820,231 | 4/1989 | Mikitka et al. | 40/411 X |
| 4,922,223 | 5/1990 | Prevot | 40/592 X |
| 5,203,219 | 4/1993 | Blanchet | 74/42 |
| 5,230,173 | 7/1993 | Riley | 40/593 X |
| 5,329,715 | 7/1994 | Po-Wen | 40/414 X |

*Primary Examiner*—Kenneth J. Dorner
*Assistant Examiner*—Joanne Silbermann
*Attorney, Agent, or Firm*—Larson & Taylor

[57] ABSTRACT

A dummy passenger is designed to be seated on the passenger side of the front seat of a car. The dummy passenger is provided therein with driving members and circuits, which enable the dummy passenger to simulate a human being so as to give a false appearance that the driver is accompanied by somebody. The head of the dummy passenger is electrically driven to move leftwards and rightwards to give a false appearance that someone, who is seated beside the driver, is talking to the driver. The simulation is made more lively by furnishing the dummy passenger with an appropriate apparel and a wig.

3 Claims, 5 Drawing Sheets

DUMMY PASSENGER

BACKGROUND OF THE INVENTION

The present invention relates to a dummy which can be seated beside the driver of a car for creating deliberately a false setting that the driver is not alone.

Driving alone at night or in a sparsely remote area can be a risky venture, especially for a lone female driver. Generally speaking, a lone driver, either male or female, is more vulnerable to being held up or assaulted. A lone female driver is especially susceptible to a verbal abuse or even a physical molestation. In addition, driving alone for a long trip can be a lonesome experience for most drivers.

SUMMARY OF THE INVENTION

It is therefore the primary objective of the present invention to provide a dummy passenger which can be seated on the passenger side of the front seat of a car and which is capable of simulating a human being to give a false appearance that the driver is not alone.

In keeping with the principle of the present invention, the foregoing objective of the present invention is attained by a dummy passenger which can be seated securely by means of a seat belt on the passenger side of the front seat of a car. The dummy passenger is provided therein with driving members and circuits, which enable the dummy passenger to simulate a human being so as to give a false appearance that the driver is accompanied by somebody. The head of the dummy passenger is electrically driven to move leftwards or rightwards to give a false appearance that someone, who is seated beside the driver, is talking to the driver. The simulation is made more lively by furnishing the dummy passenger with an appropriate apparel and a wig.

The foregoing abjective, structures, functions and features of the present invention will be more readily understood upon a thoughtful deliberation of the following detailed description of the present inveniton in conjunction with the accompanying drawings.

DETAILED DESCRIPTION OF THE INVENTION

Figure 1:
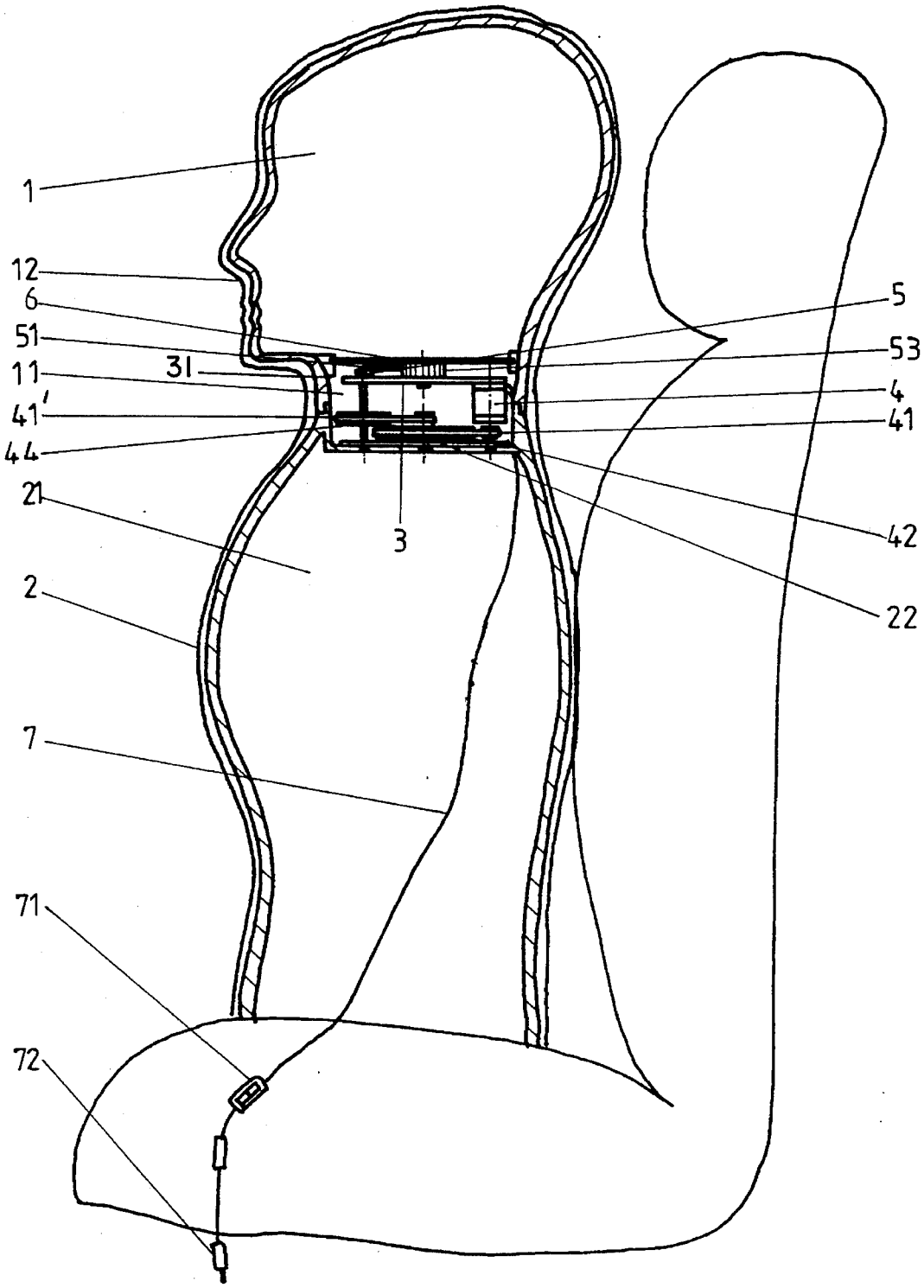
FIG. 1 shows a sectional schematic view of a dummy passenger in combination, according to the present invention.
Figure 2:
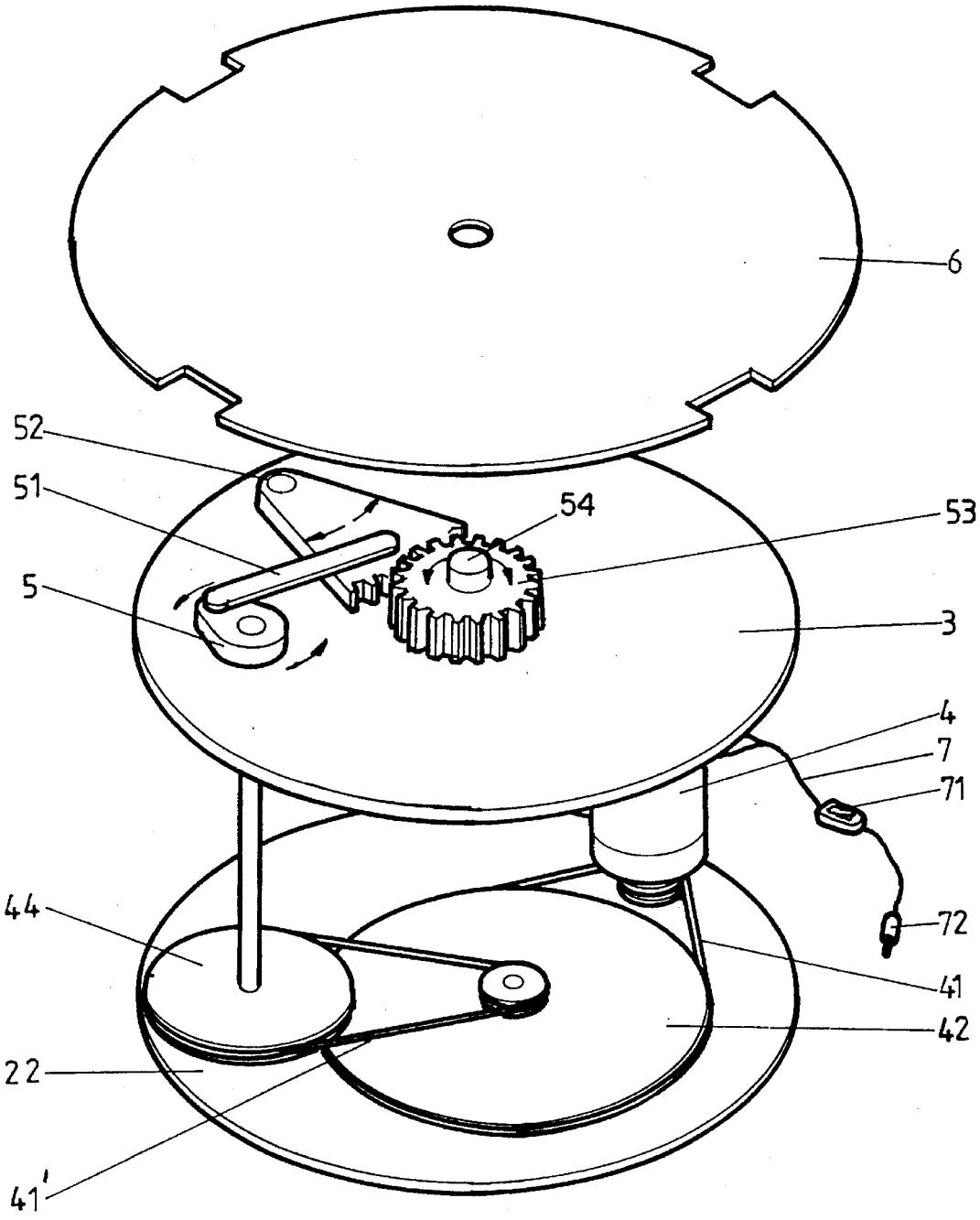
FIG. 2 shows a perspective view of a swivel gear of the dummy passenger of the present invention.
Figure 3:
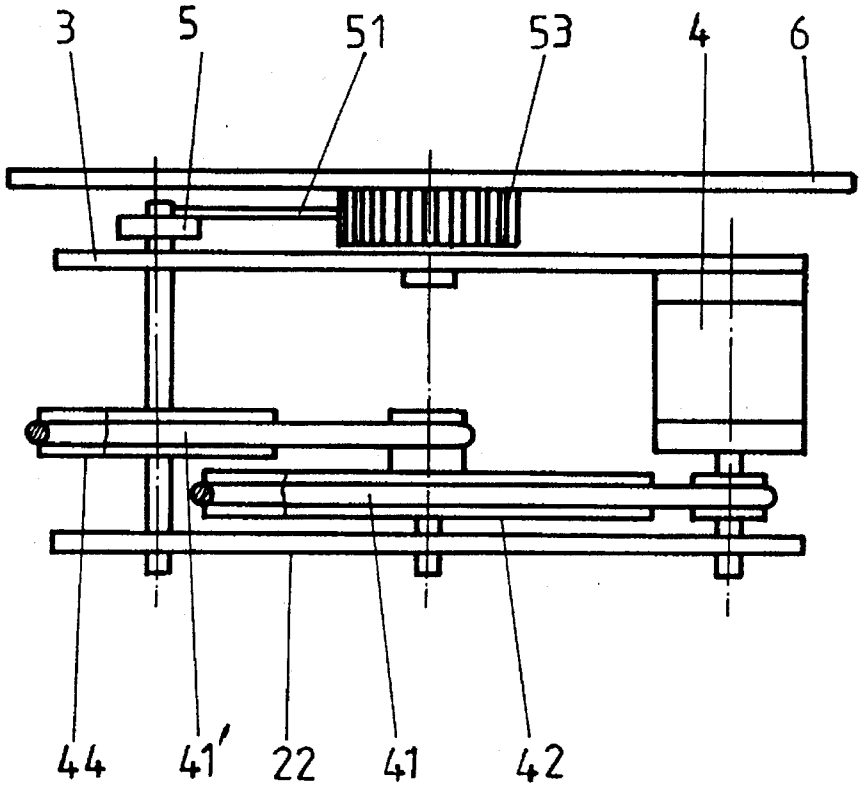
FIG. 3 shows a sectional of the swivel gear of the dummy passenger of the present invention.
Figure 4:
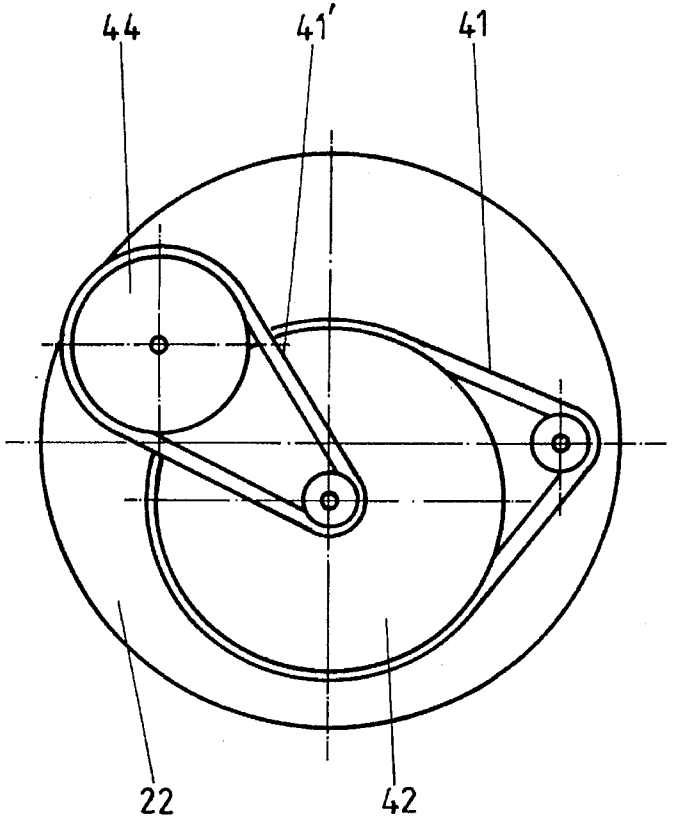
FIG. 4 shows a top plan of a drive gear of the dummy passenger of the present invention.
Figure 5:
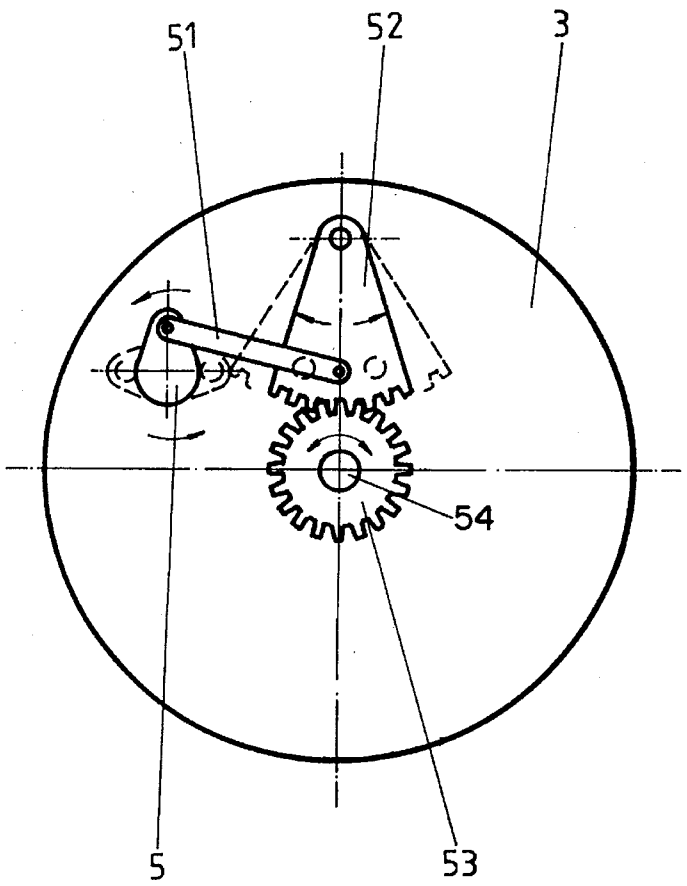
FIG. 5 shows a schematic of the swivel gear at work, according to the present invention.

As shown in FIGS. 1 and 2, the dummy passenger embodied in the present invention comprises a head 1 and a trunk 2 , which are of hollow construction and made of a plastic material or other appropriate material. The head 1 is connected with a neck 11 of the trunk 2. Located in an interior 21 of the trunk 2 is a base seat 22 provided with a retaining gear disk 3 under which a motor 4 is mounted securely. The motor 4 is linked by a belt 41 with a belted disk 42 which is fastened to the base seat 22. The belted disk 42 further linked by another belt 41' with a belted wheel 44 located between the retaining gear disk 3 and the base seat 22. The belted wheel 44 is linked with a cam 5 provided with a connection rod 51 which is fastened at one end thereof with a sectoral gear 52 engageable with a gear 53 having a shaft 54 fastened to a fastening plate 6. The motor 4 is connected with a power line 7 provided with a switch 71 and a socket 72.

The swivel mechanism of the present invention is illustrated in FIGS. 2–5.

Before the dummy passenger of the present invention is seated in a car, the head 1 and the trunk 2 of the dummy passenger are fitted into a synthetic skin 12 of a rubber material. The head 1 and trunk 2 are furnished respectively with a wig and an apparel. The socket 72 is connected with a car cirgarette lighter. As the switch 71 is turned on to start the motor 4, the belted disk 42 is driven by the belt 41. As a result, the cam 5 is actuated to rotate. The connection rod 51 is therefore caused by the rotating cam 5 to drive the sectoral gear 52 to move leftwards and rightwards in a reciprocating manner. Accordingly, the gear 53 is caused by the reciprocating motion of the sectoral gear 52 to move leftwards and rightwards in an intermittent fashion. The gear 53 is fastened with the fastening plate 6 having an outer edge which engages the lower jaw connection point 31 located at the upper portion of the inside of the neck 11. As a result, the head 1 of the dummy passenger of the present invention can be caused by the movement of the gear 53 to move leftwards and rightwards so as to give a false appearance that there is a passenger sitting beside and the driver and talking to the driver.

The dunmmy passenger of the present invention is of a hollow construction and is therefore light in weight. When not in use, the dummy passenger of the present invention can be kept easily in the car trunk.

The embodiment of the present invention described above is to be regarded in all respects a merely illustrative and not restrictive. Accordingly, the present inveniton may be embodied in other specific forms without deviating from the spirit thereof. The present invention is therefore to be limited only by the scope of the following appended claims.

What is claimed is:

1. A dummy passenger comprising a trunk having a hollow construction and including a neck at a top end of said trunk, a head connected to said neck, and a swivel mechanism positioned in said trunk, said swivel mechanism comprising:

a base seat;

a retaining gear disk fastened to said base seat;

a belted disk fastened to said base seat between said base seat and said retaining gear disk;

a motor mounted between said base seat and said retaining gear disk, said motor being linked to said belted disk by a first belt;

a belted wheel linked to said belted disk by a second belt;

a cam connected to said belted wheel by a connection rod for driving said cam;

a sectoral gear having one end fastened to said cam by a connection rod;

a second gear engaging said sectoral gear, said second gear having a shaft thereon; and a fastening plate mounted on said shaft and fastened to a lower jaw of said head for moving said head rightwards and leftwards in a reciprocating manner with respect to said neck.

2. The dummy passenger according to claim 1 further comprising a power cord attached to said motor, said power cord having a terminal adapted for use in a cigarette lighter of an automobile.

3. The dummy passenger according to claim 1 further comprising a wig for said head and apparel for said trunk.

* * * * *